US005404957A

United States Patent [19]

McCormack

[11] Patent Number: 5,404,957

[45] Date of Patent: Apr. 11, 1995

[54] FIRE RETARDANT FOAM GENERATOR

[76] Inventor: Pat McCormack, 1019 S. Arlington, Reno, Nev. 89509

[21] Appl. No.: 138,913

[22] Filed: Oct. 18, 1993

[51] Int. Cl.[6] ..... A62C 31/12

[52] U.S. Cl. ..... 169/70; 169/15; 239/432; 239/590.3; 239/590.5; 285/320

[58] Field of Search ..... 169/14, 15, 70; 239/432, 525, 590, 590.3, 590.5; 285/320

[56] References Cited

U.S. PATENT DOCUMENTS 1,910,706 5/1933 Malzard ..... 285/320 X
2,774,583 12/1956 Hafte ..... 261/76
3,561,536 2/1971 Henshaw ..... 169/15
3,667,687 6/1972 Rivking et al. ..... 239/553.3

*Primary Examiner*—David M. Mitchell
*Assistant Examiner*—Andrew C. Pike
*Attorney, Agent, or Firm*—Bielen, Peterson & Lampe

[57] ABSTRACT

A generator for fire retardant foam utilizes a foamable liquid in a fire hose terminating in a nozzle. The generator includes a housing having an inner chamber with a first entrance opening and a second exit opening. A moveable screen is disposed within the housing to aid in the generation of the foam. A connector is also employed for fastening the housing to the fire hose nozzle utilizing a plurality of hingable elements connected to the housing and a clamp for fixing the plurality of elements to the exterior of the fire hose.

9 Claims, 1 Drawing Sheet

FIRE RETARDANT FOAM GENERATOR

BACKGROUND OF THE INVENTION

The present invention relates to a novel fire retardant foam generator usable with a conventional fire hose nozzle.

Fire extinguishing materials include the use of water, and foam producing chemicals. Fire hoses normally deliver water under pressure received from a particular utility agency, or pressure provided by a pumping mechanism, such as a pumper truck.

Certain fires classified as class B and class C require extinguishing based on principles other than the cooling effect provided by water. For example, foam type extinguishing materials spread a layer of foam over burning material and extinguishes the fire by excluding oxygen. Similarly, fire extinguishing systems employ carbon dioxide, halogen, and the like to remove oxygen.

Foam materials have been applied to wildland types of fires by utilizing fire hoses and fire hose nozzles, generally employed with simple water delivery in conjunction with foam generating equipment. In this regard, U.S. Pat. Nos. 2,774,583 and 3,667,687 describe apparatuses for producing foams to fight fires which may be used with or in substitution for nozzles employed with large fire hoses.. Attention is also drawn to a foam making attachment for fire hose nozzles known as MX-Foamjet manufactured by Task Force Tips of Valparaiso, Ind. Prior art devices, however, are difficult to adapt to fire hose nozzles of different sizes. Such lack of universal fittings and connectors is often fatal during fire emergencies.

A fire retardant foam generator which is simple to manufacture, use, and adapt to existing fire hose nozzles would be a notable advance in the fire fighting field.

SUMMARY OF THE INVENTION

In accordance with the present invention a novel and useful fire retardant foam generator is provided.

The generator of the present invention utilizes a housing having a chamber with a first entrance opening and a second opening for egress. The housing may be formed of any rigid or semi-rigid material. A handle portion may be provided to extend from the housing. Such handle portion may take the form of a ring-shaped member connected to the external wall of the housing. In addition, at least one screen may be placed within the housing to disperse the foam and water mixture passed into the housing through a fire hose. Means may also be included in the present invention for positioning one or more screens within the housing at various positions therewithin. Such positioning means may take the form of a series of bores through the housing which are capable of permitting fasteners to pass through the same and engage one or more screens within the housing chamber. Bores which are not being employed for this purpose may be easily plugged by unused threaded fasteners or other plugs which are easily removable and replaceable in such bores. The screens disposed within the housing may take various shapes depending on characteristics of the foam generating material as well as the velocity of the foam and water stream and the like. Such screen shapes would be selected to produce foam streams which project various distances and spread at various widths when leaving the generator of the present invention.

Connecting means is also found in the present invention for fastening the housing to the fire hose nozzle to permit flow of the foamable liquid from the fire hose into and out of the housing for fighting a fire. Such connecting means possess a plurality of elements which are hingedly attached to the housing at the first opening to the same. Such hingable elements may include a first portion forming part of the housing and a second flange portion which extends over the fire hose nozzle. The second flange portion may also be provided with a sealing element such as an elastomeric material to aid in the gripping of the second flange portion to the fire hose nozzle. A clamp is employed to fix the connection means to the fire hose nozzle such that turning or rotation of the housing, with or without the aid of the handle, will also turn the fire hose nozzle and adjust the stream of fluid flowing therethrough.

A shock absorbing element may also be connected to the housing in the vicinity of the second opening thereto. Such shock absorbing element may be constructed of a ring of elastomeric material. Thus, damage to the generator of the present invention is minimized.

It may be apparent that a novel and useful fire retardant foam generator has been described.

It is therefore an object of the present invention to provide a fire retardant foam generator which is capable of being fastened to a conventional fire hose for the purpose of foam generation and control of the fire hose effluent stream.

Another object of the present invention is to provide a fire retardant foam generator which includes a housing having a chamber with screens that are adjustably positioned therewithin to coincide with the flow and pressure characteristics of the stream exiting the fire hose nozzle.

A further object of the present invention is to provide a fire retardant foam generator which includes connecting means permitting the generator to be attached to fire hose nozzles of different sizes and shapes.

A further object of the present invention is to provide a fire retardant foam generator which may be employed simply and quickly to fight wild fires in remote areas.

The invention possesses other objects and advantages especially as concerns particular characteristics and features thereof which will become apparent as the specification continues.

For a better understanding of the invention, references made to the following detailed description of the preferred embodiments thereof which should be referenced to the prior described drawings.

DETAILED DESCRIPTION OF THE PREFERRED EMBODIMENTS

Various aspects of the present invention will evolve from the following detailed description of the preferred embodiments thereof which should be taken in conjunction with the prior described drawings.

Figure 1:
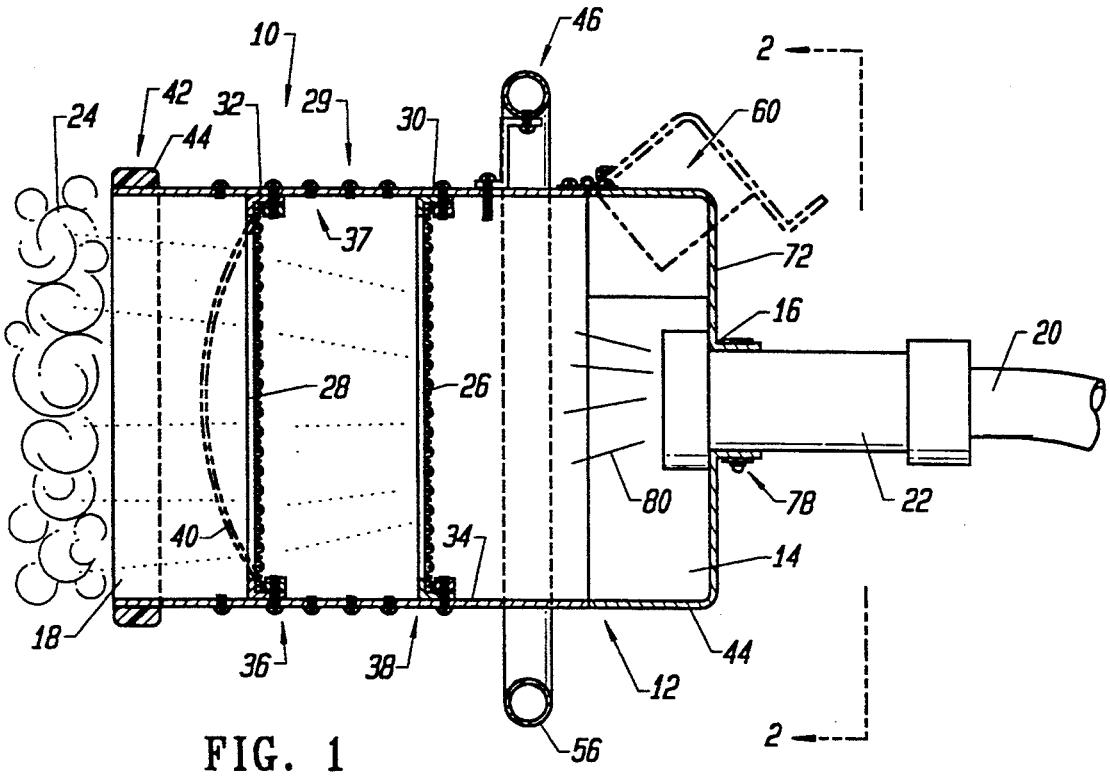
FIG. 1 is a side sectional view of the generator of the present invention with one of the elements of the connecting means and rotated outwardly in phantom.

The invention as a whole is depicted in the drawings by reference character 10. The fire retardant foam generator 10 includes as one of its elements a housing 12, FIG. 1, which is provided with a chamber 14 therewithin. Housing 12 may be constructed of any rigid or semi-rigid material such as metal, plastic, wood, and the like. As depicted in FIG. 1, housing 12 is constructed of metallic material and is substantially cylindrical in shape. Housing 12 includes a first opening 16 and a second opening 18. First opening 16 permits the flow of foamable material from fire hose 20 via nozzle 22, which will be described in detail hereinafter. Second opening 18 is intended to permit the egress of foam retardant material in order to fight a fire. Such foam material 24 is depicted in FIG. 1. Foamable material is injected into fire hose 20 prior to arrival at nozzle 20 and generator 10. Such injection is known in the art and has been used with prior foam generating devices.

Housing 12 is provided with screens 26 and 28 which are generally circular in shape. Screens 26 and 28 include flanges 30 and 32, respectively, which ride on the inner surface 34 of housing 12. Plurality of fasteners 36 are capable of passing through plurality of bores 37 which extend through housing 12 to chamber 14 therewithin. Plurality of fasteners 36 are shown as taking the form of round-headed screws that engage flanges 30 and 32 having threaded receptors therealong. Of course, other fasteners may be employed in this regard such as expandable rings, pins, ties, and the like. Fastening means 38 for fixing screens 26 and 28 to housing 12, as described above, permit the moving of screens along the interior surface 34 of chamber 12 to accommodate the particular flow rate and pressure of material exiting nozzle 22. In addition, a screen 40 is depicted in phantom in FIG. 1 as having a curved or domed- shaped configuration. It should be understood that screens found within chamber 14 may take any suitable shape necessary to generate foam material 24. Plugs 29 may occupy any bores 37 not cooperating with fasteners 36.

A shock absorbing element 42 is also illustrated in FIG. 1. Element 42 may take the form of an elastomeric band 44 which is tightly held to exterior surface 44 of housing 12 by compression, gluing, and the like. Shock absorbing element 42 is intended to protect generator 10 against droppage and mechanical forces inherent in fighting fires, especially in wilderness areas. In addition, a handle 46 is connected by z-shaped brackets 48, 50, and 52 to exterior surface 44. A multiplicity of fasteners 54 serve to mount z-shaped brackets 48, 50, and 52 to ring 56 and the exterior 44 of housing 12. Ring 56 is easily grippable by the user of generator 10 to hold or twist housing 12.

Figure 2:
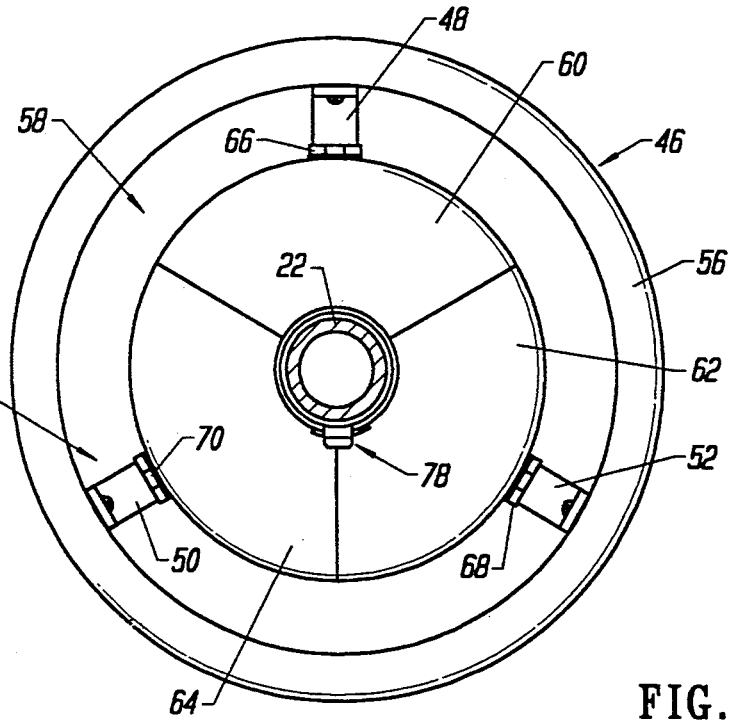
FIG. 2 is a sectional view taken along line 2—2 of FIG. 1.
Figure 3:
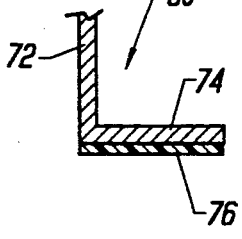
FIG. 3 is a sectional view of the end portion of one of the connecting elements depicted in FIG. 1.

Connecting means 58 externalizes in a trio of elements 60, 62, and 64 which are hingably attached to exterior surface 44 of housing 12 through hinges 66, 68, and 70, FIG. 2. Each of the elements 60, 62, and 64 are identically constructed in the embodiment shown in FIGS. 1 and 2. By way of example, element 60 possesses a first portion 72 which forms a part of housing 12. A second flange portion 74 extends outwardly from housing 12 and includes an elastomeric strip 76, FIGS. 1 and 3. Clamp 78, in the form of a cinching band, commonly known as "plumber's tape" holds flange 74 and identical flanges from elements 62 and 64 to the exterior of fire hose nozzle 22. Clamp 78 exerts sufficient force such that the rotation of housing 12 also rotates the fire hose nozzle 22.

In operation, the user attaches generator 10 to fire hose nozzle 22 by employing a clamp 78. Clamp 78 brings together the second flange portions, such as flange portion 74 of element 60, of elements 60, 62, and 64. Clamp 78 is tightened sufficiently to firmly hold elements 60, 62, and 64 to nozzle 22 such that housing 12 and nozzle 22 move as a unit. A foamable material is passed through hose 20 to nozzle 22 and into housing 12 chamber 14. Screens 26 and 28 adjustably fastened therein by fastening means 38 serve to create foam material 24 exiting generator 10. Where the foamable material stream 80 exiting nozzle 22 is of relatively high pressure, screens 26 and 28 would be separated at greater distance from each other than shown in FIG. 1. On the other hand, a relative low pressure effluent 80 from nozzle 22 will require screens 26 and 28 to be placed closer to one another than the depiction shown in FIG. 1. Of course, screens of various size and shapes may be used within chamber 14, such as domed-shaped screen 40 depicted in phantom on FIG. 1. The user of generator 10 would grip ring 56 of handle 46 and direct foam material 26 to a fire. Rotation of housing 12 and nozzle 22 may take place by twisting ring 56. Such turning changes the characteristic of the effluent stream from nozzle 22. A fog-like stream or to a straight-stream, as well as streams exhibiting characterization between such extremes, may flow from nozzle 22 by such process. Shock absorbing element 42 would aid in the protection of housing 12 from damage during usage in fighting a fire. It should be noted that connected means 58 permits the fixing of housing 12 to fire hose nozzles of different shapes and sizes. It has been found that this feature is particularly useful in fire emergencies in remote areas that may extend among multiple fire districts where nozzles of different sizes may be encountered.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is

1. A fire retardant generator utilizing a foamable liquid and a fire base terminating in a nozzle, said generator comprising:

(a) a housing including a base wall and a plurality of hinged walls hingedly attached to said base wall, and a chamber having a first opening and a second opening;

(b) a screen disposed within said housing chamber between said first and second openings; and (c) connecting means for fastening said housing to the nozzle to permit flow of the foamable liquid from the fire base to said housing, said connecting means including said plurality of said hinged walls and a clamp for fixing said plurality of said hinged walls to an exterior of the nozzle, to permit the flow of the foamable liquid therefrom to said first opening of said housing and through said second opening of said housing.

2. The generator of claim 1 which further comprises fastening means for fixing said screen at selective positions within said chamber of said housing.

3. The generator of claim 2 which additionally comprises a handle connected to an exterior of said housing.

4. The generator of claim 3 in which said handle is a ring-shaped member at least partially surrounding said housing.

5. The generator of claim 2 in which said fastening means for fixing said screen at selective positions within said chamber of said housing comprises a plurality of bores extending through said housing, and a plurality of fasteners capable of extending through said housing, and a plurality of fasteners capable of extending through said housing and engaging said screen within said housing.

6. The generator of claim 1 which additionally comprises a shock absorbing element, said element being affixed to said housing in a vicinity of said second opening of said housing.

7. The generator of claim 1 in which said hinged walls each includes a first portion and a second flange portion; wherein said first portions, when said hinged walls are fixed by said clamp, together with said base wall form one continuous wall, and said second flange portions are attachable by said clamp to the nozzle.

8. The generator of claim 7 in which said each second flange portion includes a sealing element connected thereto.

9. The generator claim 1 in which said clamp exerts sufficient force on the nozzle such that turning of said housing rotates the nozzle.

* * * * *